US009957853B2

(12) United States Patent
Haltiner, Jr.

(10) Patent No.: US 9,957,853 B2
(45) Date of Patent: May 1, 2018

(54) CAMSHAFT PHASER

(71) Applicant: DELPHI TECHNOLOGIES IP LIMITED, St. Michael (BB)

(72) Inventor: Karl J. Haltiner, Jr., Fairport, NY (US)

(73) Assignee: DELPHI TECHNOLOGIES IP LIMITED (BB)

( * ) Notice: Subject to any disclaimer, the term of this patent is extended or adjusted under 35 U.S.C. 154(b) by 8 days.

(21) Appl. No.: 15/251,743

(22) Filed: Aug. 30, 2016

(65) Prior Publication Data

US 2018/0058272 A1 Mar. 1, 2018

(51) Int. Cl.
*F01L 1/34* (2006.01)
*F01L 1/344* (2006.01)

(52) U.S. Cl.
CPC ... *F01L 1/3442* (2013.01); *F01L 2001/34433* (2013.01); *F01L 2001/34479* (2013.01)

(58) Field of Classification Search
CPC ..... F01L 1/3442; F01L 2001/34433; F01L 2001/34479
See application file for complete search history.

(56) References Cited

U.S. PATENT DOCUMENTS 7,389,756 B2 6/2008 Hoppe et al.
8,789,504 B2 7/2014 Scheidig
8,863,713 B2 10/2014 Schafer et al.
8,931,451 B2 1/2015 Scheidig
8,973,544 B2 3/2015 Busse et al.
2001/0013324 A1* 8/2001 Yoshizawa ..... F01L 1/34 123/90.16
2015/0300212 A1 10/2015 Bayrakdar

FOREIGN PATENT DOCUMENTS

DE 102014220278 A1 4/2016

* cited by examiner

*Primary Examiner* — Zelalem Eshete
(74) *Attorney, Agent, or Firm* — Joshua M. Haines

(57) ABSTRACT

A camshaft phaser includes an input member; an output member defining an advance chamber and a retard chamber with the input member; a camshaft phaser attachment bolt which clamps the camshaft phaser to a camshaft, the camshaft phaser attachment bolt having a bolt valve bore extending along an axis. A valve sleeve is located coaxially within the bolt valve bore such that an annular clearance is provided radially therebetween. A valve spool is located coaxially within the valve sleeve such that the valve spool is moved coaxially between an advance position and a retard position. A compliant sealing ring radially between the bolt valve bore and the valve sleeve prevents fluid communication through the annular clearance axially between opposing axial sides of the sealing ring and isolates the valve sleeve from radial expansion of the camshaft phaser attachment bolt.

17 Claims, 9 Drawing Sheets

CAMSHAFT PHASER

TECHNICAL FIELD OF INVENTION

The present invention relates to a camshaft phaser for varying the phase relationship between a crankshaft and a camshaft in an internal combustion engine; more particularly to such a camshaft phaser which is a vane-type camshaft phaser; still even more particularly to such a camshaft phaser which includes a camshaft phaser attachment bolt which both clamps the camshaft phaser to camshaft and includes a valve spool therein for controlling the flow of oil used to rotate a rotor of the camshaft phaser relative to a stator of the camshaft phaser; and yet even more particularly to such a camshaft phaser which isolates the valve spool from radial inward expansion of the camshaft phaser attachment bolt when the camshaft phaser bolt is tightened to the camshaft.

BACKGROUND OF INVENTION

A typical vane-type camshaft phaser for changing the phase relationship between a crankshaft and a camshaft of an internal combustion engine generally comprises a plurality of outwardly-extending vanes on a rotor interspersed with a plurality of inwardly-extending lobes on a stator, forming alternating advance and retard chambers between the vanes and lobes. Engine oil is selectively supplied to one of the advance and retard chambers and vacated from the other of the advance and retard chambers by a phasing oil control valve in order to rotate the rotor within the stator and thereby change the phase relationship between the camshaft and the crankshaft. Some camshaft phasers incorporate a valve spool within a camshaft phaser attachment bolt which is used to secure the camshaft phaser to the camshaft. The valve spool is moved axially within the camshaft phaser attachment bolt to open and close passages which results in oil being directed to and from the advance and retard chambers as needed in order to rotate the rotor within the stator. The clearance between the valve spool and the camshaft phaser attachment bolt must be minimized in order to control leakage between the corresponding interface; however, the clearance between the valve spool and the camshaft phaser attachment bolt must be sufficiently great to accommodate radially inward expansion of the camshaft phaser attachment bolt when the camshaft phaser attachment bolt is tightened to the camshaft in order to avoid binding of the valve spool within the camshaft phaser attachment bolt. The camshaft phaser attachment bolt may typically expand radially inward by 0.010 mm diametrically with great variability. Consequently, in order accommodate radially inward expansion of camshaft phaser attachment bolt and variability thereof, a larger clearance than desired to minimize leakage may need to be provided in order to ensure proper movement of the valve spool after the camshaft phaser attachment bolt is tightened to the camshaft.

What is needed is camshaft phaser which minimizes or eliminates one or more the shortcomings as set forth above.

SUMMARY OF THE INVENTION

Briefly described, a camshaft phaser is provided for use with an internal combustion engine for controllably varying the phase relationship between a crankshaft and a camshaft in the internal combustion engine. The camshaft phaser includes an input member connectable to the crankshaft of the internal combustion engine to provide a fixed ratio of rotation between the input member and the crankshaft; an output member connectable to the camshaft of the internal combustion engine and defining an advance chamber and a retard chamber with the input member; a camshaft phaser attachment bolt which clamps the camshaft phaser to the camshaft, the camshaft phaser attachment bolt having a bolt valve bore extending along an axis, a bolt advance passage providing fluid communication between the advance chamber and the bolt valve bore, and a bolt retard passage providing fluid communication between the retard chamber and the bolt valve bore; a valve sleeve coaxially within the bolt valve bore such that an annular clearance is defined radially between the valve sleeve and the bolt valve bore, the valve sleeve having a sleeve bore, a sleeve advance passage proving fluid communication between the bolt advance passage and the sleeve bore, and a sleeve retard passage providing fluid communication between the bolt retard passage and the sleeve bore; a valve spool within the sleeve bore, the valve spool being displaced axially within the sleeve bore between 1) an advance position which directs oil into the retard chamber and vents oil from the advance chamber, thereby causing the output member to rotate relative to the input member in an advance direction and 2) a retard position which directs oil into the advance chamber and vents oil from the retard chamber, thereby causing the output member to rotate relative to the input member in a retard direction; and a compliant sealing ring radially between the bolt valve bore and the valve sleeve which engages the bolt valve bore and the valve sleeve, the sealing ring preventing fluid communication through the annular clearance axially between opposing axial sides of the sealing ring and the sealing ring also accommodating radially inward expansion of the camshaft phaser attachment bolt within the annular clearance such that the sealing ring isolates the valve sleeve from radial expansion of the camshaft phaser attachment bolt.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
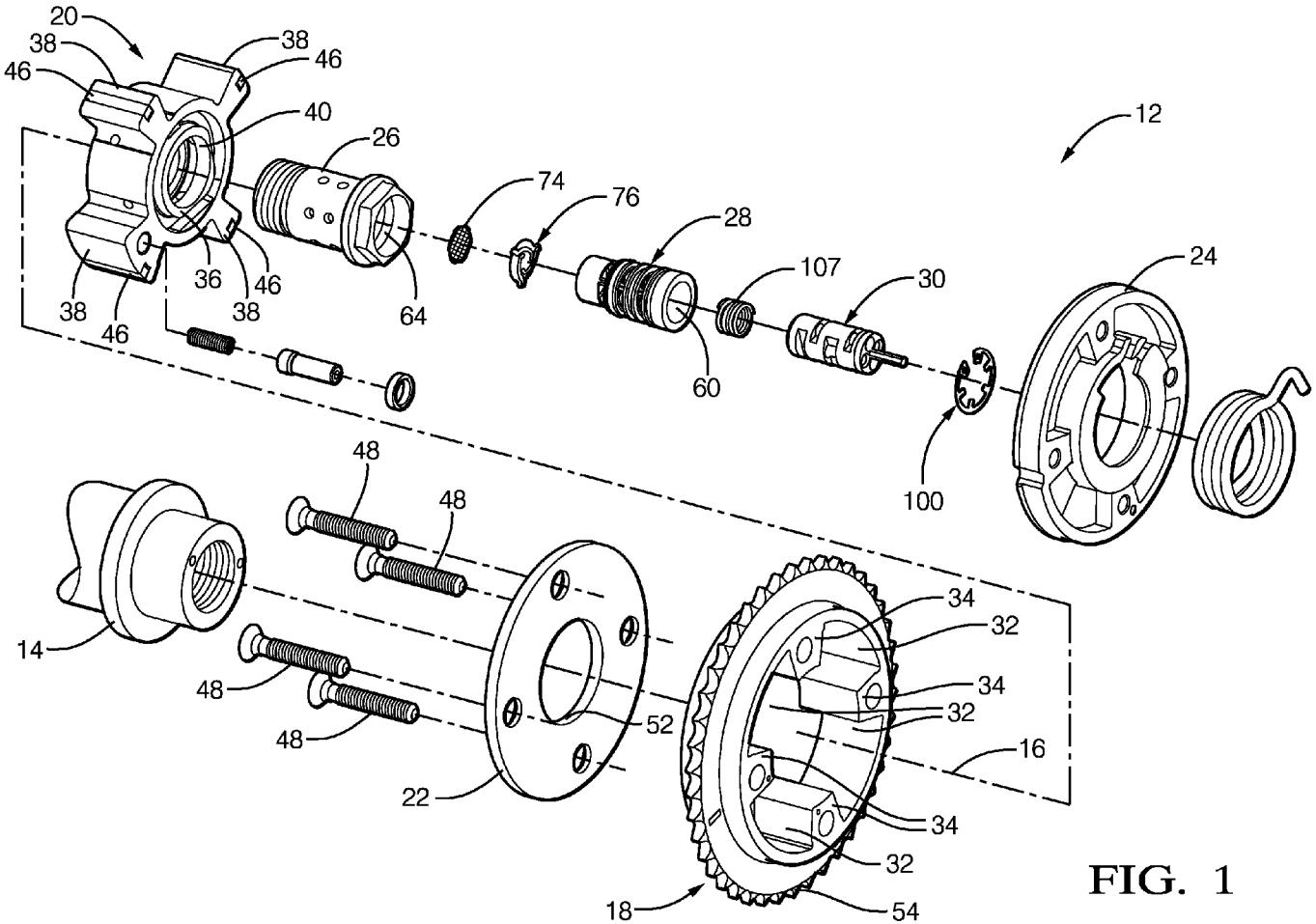
FIG. 1 is an exploded isometric view of a camshaft phaser in accordance with the present invention.

In accordance with a preferred embodiment of this invention and referring to FIGS. 1-3A, an internal combustion engine 10 is shown which includes a camshaft phaser 12. Internal combustion engine 10 also includes a camshaft 14 which is rotatable about a camshaft axis 16 based on rotational input from a crankshaft and chain (not shown) driven by a plurality of reciprocating pistons (also not shown). As camshaft 14 is rotated, it imparts valve lifting and closing motion to intake and/or exhaust valves (not shown) as is well known in the internal combustion engine art. Camshaft phaser 12 allows the timing between the crankshaft and camshaft 14 to be varied. In this way, opening and closing of the intake and/or exhaust valves can be advanced or retarded in order to achieve desired engine performance.

Camshaft phaser 12 generally includes a stator 18 which acts as an input member, a rotor 20 disposed coaxially within stator 18 which acts as an output member, a back cover 22 closing off one end of stator 18, a front cover 24 closing off the other end of stator 18, a camshaft phaser attachment bolt 26 for attaching camshaft phaser 12 to camshaft 14, a valve sleeve 28 within camshaft phaser attachment bolt 26, and a valve spool 30 within valve sleeve 28. The various elements of camshaft phaser 12 will be described in greater detail in the paragraphs that follow.

Stator 18 is generally cylindrical and includes a plurality of radial chambers 32 defined by a plurality of lobes 34 extending radially inward. In the embodiment shown, there are four lobes 34 defining four radial chambers 32, however, it is to be understood that a different number of lobes 34 may be provided to define radial chambers 32 equal in quantity to the number of lobes 34. Stator 18 may include a sprocket 54 formed integrally therewith or otherwise fixed thereto. Sprocket 54 is configured to be driven by a chain that is driven by the crankshaft of internal combustion engine 10. Alternatively, sprocket 54 may be a pulley driven by a belt or any other known drive member known for driving camshaft phaser 12 by the crankshaft. In an alternative arrangement, sprocket 54 may be integrally formed or otherwise attached to back cover 22 rather than stator 18.

Rotor 20 includes a central hub 36 with a plurality of vanes 38 extending radially outward therefrom and a rotor central through bore 40 extending axially therethrough. The number of vanes 38 is equal to the number of radial chambers 32 provided in stator 18. Rotor 20 is coaxially disposed within stator 18 such that each vane 38 divides each radial chamber 32 into advance chambers 42 and retard chambers 44. The radial tips of lobes 34 are mateable with central hub 36 in order to separate radial chambers 32 from each other. Each of the radial tips of vanes 38 may include one of a plurality of wiper seals 46 to substantially seal adjacent advance chambers 42 and retard chambers 44 from each other. While not shown, each of the radial tips of lobes 34 may also include one of a plurality of wiper seals 46.

Back cover 22 is sealingly secured, using cover bolts 48, to the axial end of stator 18 that is proximal to camshaft 14. Tightening of cover bolts 48 prevents relative rotation between back cover 22 and stator 18. Back cover 22 includes a back cover central bore 52 extending coaxially therethrough. The end of camshaft 14 is received coaxially within back cover central bore 52 such that camshaft 14 is allowed to rotate relative to back cover 22.

Similarly, front cover 24 is sealingly secured, using cover bolts 48, to the axial end of stator 18 that is opposite back cover 22. Cover bolts 48 pass through back cover 22 and stator 18 and threadably engage front cover 24; thereby clamping stator 18 between back cover 22 and front cover 24 to prevent relative rotation between stator 18, back cover 22, and front cover 24. In this way, advance chambers 42 and retard chambers 44 are defined axially between back cover 22 and front cover 24.

Camshaft phaser 12 is attached to camshaft 14 with camshaft phaser attachment bolt 26 which extends coaxially through rotor central through bore 40 of rotor 20 and threadably engages camshaft 14, thereby by clamping rotor 20 securely to camshaft 14. In this way, relative rotation between stator 18 and rotor 20 results in a change is phase or timing between the crankshaft of internal combustion engine 10 and camshaft 14.

Oil is selectively supplied to advance chambers 42 from an oil source 55, for example an oil pump of internal combustion engine 10 which may also provide lubrication to various elements of internal combustion engine 10, in order to cause relative rotation between stator 18 and rotor 20 which results in retarding the timing of camshaft 14 relative to the crankshaft of internal combustion engine 10. When oil is supplied to advance chambers 42 in order to retard the timing of camshaft 14, oil is also vented from retard chambers 44. Conversely, oil is selectively supplied to retard chambers 44 from oil source 55 in order to cause relative rotation between stator 18 and rotor 20 which results in advancing the timing of camshaft 14 relative to the crankshaft of internal combustion engine 10. When oil is supplied to retard chambers 44 in order to advance the timing of camshaft 14, oil is also vented from advance chambers 42. Rotor advance passages 56 may be provided in rotor 20 for supplying and venting oil to and from advance chambers 42 while rotor retard passages 58 may be provided in rotor 20 for supplying and venting oil to and from retard chambers 44. Supplying and venting oil to and from advance chambers 42 and retard chambers 44 is controlled by valve spool 30, as will be described in detail later, such that valve spool 30 is coaxially disposed slidably within a sleeve bore 60, centered about camshaft axis 16, of valve sleeve 28 and such that valve sleeve 28 is disposed coaxially within a bolt valve bore 64, centered about camshaft axis 16, of camshaft phaser attachment bolt 26.

Figure 6:
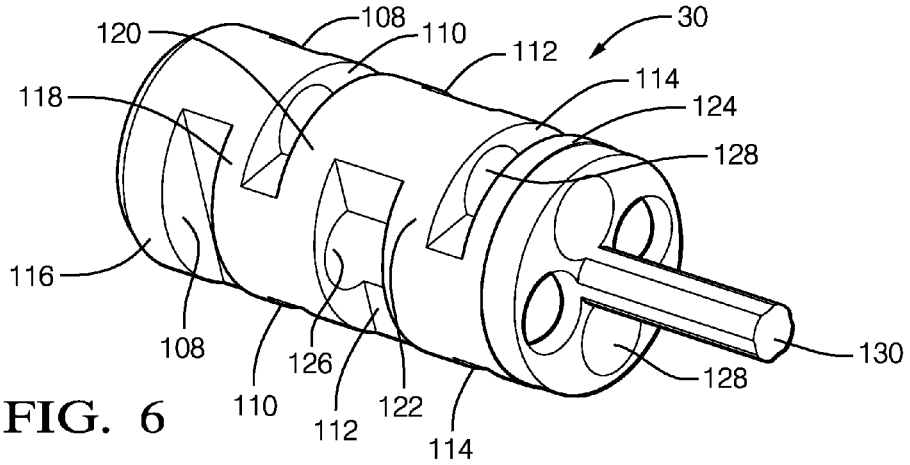
FIG. 6 is an isometric view of the valve spool of the camshaft phaser in accordance with the present invention.
Figure 7:
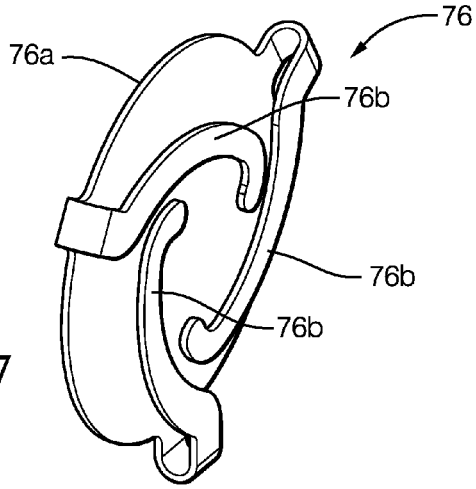
FIG. 7 is an isometric view of a check valve of the camshaft phaser in accordance with the present invention.
Figure 8:
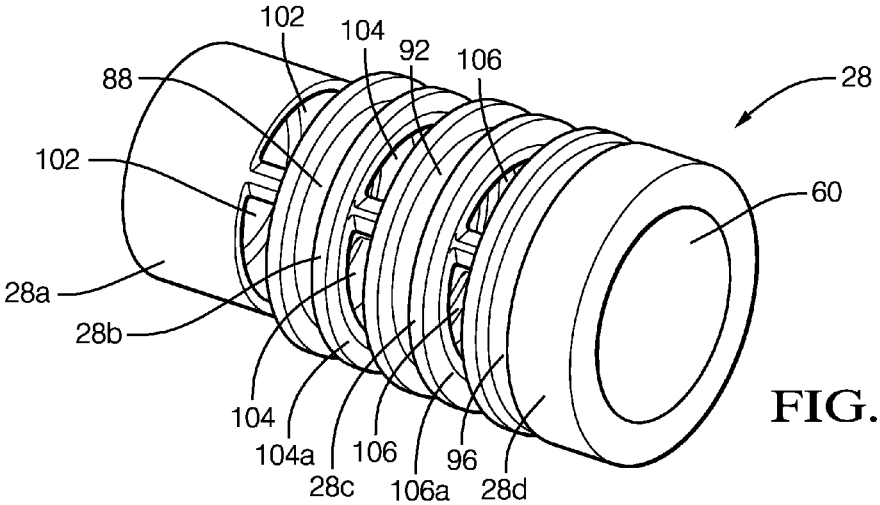
FIG. 8 is an isometric view of a valve sleeve of the camshaft phaser in accordance with the present invention.

Camshaft phaser attachment bolt 26, valve sleeve 28, and valve spool 30, which act together to function as a valve, will now be described in greater detail with continued reference to FIGS. 1-3A and now with additional reference to FIGS. 6-8. Camshaft phaser attachment bolt 26 includes a bolt supply passage 66 which extends axially outward from bolt valve bore 64 to the outside surface at the axial end of camshaft phaser attachment bolt 26 which threadably engages camshaft 14. Bolt supply passage 66 receives pressurized oil from oil source 55 via a camshaft supply bore 70 which extends coaxially into camshaft 14 and also via radial camshaft oil passages 72 which extend radially outward from camshaft supply bore 70. A filter 74 is located in bolt supply passage 66 in order to prevent foreign matter that may be present in the oil from reaching valve spool 30 and a check valve 76 is located in bolt valve bore 64 between camshaft phaser attachment bolt 26 and valve sleeve 28 in order to allow oil to flow into bolt valve bore 64 through bolt supply passage 66 while preventing oil from flowing out of bolt valve bore 64 through bolt supply passage 66.

Bolt valve bore 64 preferably includes five sections, each of which has a distinct diameter such that each section is progressively smaller than the previous section from the end of camshaft phaser attachment bolt 26 that is distal from camshaft 14 to the end of camshaft phaser attachment bolt 26 that is proximate to camshaft 14. A bolt valve bore supply section 64*a* of bolt valve bore 64 is immediately adjacent to bolt supply passage 66. A bolt valve bore sealing section 64*b* is immediately adjacent to bolt valve bore supply section 64*a* such that bolt valve bore supply section 64*a* is between bolt valve bore sealing section 64*b* and bolt supply passage 66. The transition between bolt valve bore supply section 64*a* and bolt valve bore sealing section 64*b* may form a shoulder that is perpendicular to camshaft axis 16 as shown. A bolt valve bore advance section 64*c* is immediately adjacent to bolt valve bore sealing section 64*b* such that bolt valve bore sealing section 64*b* is between bolt valve bore advance section 64*c* and bolt valve bore supply section 64*a*. The transition between bolt valve bore advance section 64*c* and bolt valve bore sealing section 64*b* is preferably oblique to camshaft axis 16. A bolt valve bore retard section 64*d* is immediately adjacent to bolt valve bore advance section 64*c* such that bolt valve bore advance section 64*c* is between bolt valve bore retard section 64*d* and bolt valve bore sealing section 64*b*. The transition between bolt valve bore retard section 64*d* and bolt valve bore advance section 64*c* is preferably oblique to camshaft axis 16. A bolt valve bore retention section 64*e* is immediately adjacent to bolt valve bore retard section 64*d* such that bolt valve bore retard section 64*d* is between bolt valve bore retention section 64*e* and bolt valve bore advance section 64*c*. The transition between bolt valve bore retention section 64*e* and bolt valve bore retard section 64*d* is preferably oblique to camshaft axis 16.

For clarity, it should now be understood that bolt valve bore retard section 64*d* is smaller in diameter than bolt valve bore retention section 64*e*, bolt valve bore advance section 64*c* is smaller in diameter than bolt valve bore retard section 64*d*, bolt valve bore sealing section 64*b* is smaller in diameter than bolt valve bore advance section 64*c*, and bolt valve bore supply section 64*a* is smaller in diameter than bolt valve bore sealing section 64*b*.

Camshaft phaser attachment bolt 26 also includes bolt advance passages 78 which extend radially outward from bolt valve bore 64, and more specifically bolt valve bore advance section 64*c*, to the outer periphery of camshaft phaser attachment bolt 26 such that bolt advance passages 78 are centered about a circular centerline that is perpendicular to camshaft axis 16. Bolt advance passages 78 are aligned with a rotor annular advance groove 80 which extends radially outward from rotor central through bore 40 such that rotor advance passages 56 extend from rotor annular advance groove 80 to advance chambers 42. In this way, fluid communication is provided between bolt valve bore 64 and advance chambers 42.

Camshaft phaser attachment bolt 26 also includes bolt retard passages 82 which extend radially outward from bolt valve bore 64, more specifically bolt valve bore retard section 64*d*, to the outer periphery of camshaft phaser attachment bolt 26 such that bolt retard passages 82 are centered about a circular centerline that is perpendicular to camshaft axis 16 and such that bolt retard passages 82 are offset from bolt advance passages 78 in the direction of camshaft axis 16 away from camshaft 14. Bolt retard passages 82 are aligned with a rotor annular retard groove 84 which extends radially outward from rotor central through bore 40 such that rotor retard passages 58 extend from rotor annular retard groove 84 to retard chambers 44. In this way, fluid communication is provided between bolt valve bore 64 and retard chambers 44.

Valve sleeve 28 preferably includes four sections, each of which has a distinct external diameter such that each section is progressively smaller than the previous section from the end of the end of valve sleeve 28 that is distal from camshaft 14 to the end of valve sleeve 28 that is proximate to camshaft 14. A sleeve supply section 28*a* of valve sleeve 28 is provided at the end of valve sleeve 28 that is proximate to bolt supply passage 66. Sleeve supply section 28*a* is located within bolt valve bore supply section 64*a* such that an annular space 86 is defined radially between sleeve supply section 28*a* and bolt valve bore supply section 64*a*. Annular space 86 provides a diametric clearance which provides supply flow to accommodate the phasing rate of camshaft phaser 12, and by way of non-limiting example only, is a diametric clearance in the range of 1 mm to 3 mm.

A sleeve advance section 28*b* is immediately adjacent to sleeve supply section 28*a* and is located partially within bolt valve bore sealing section 64*b* and partially within bolt valve bore advance section 64*c*. Sleeve advance section 28*b* and bolt valve bore sealing section 64*b* are sized to provide an annular clearance therebetween which accommodates radially inward expansion of camshaft phaser attachment bolt 26 when camshaft phaser attachment bolt 26 is tightened to camshaft 14, i.e. the annular clearance is greater than the extent to which camshaft phaser attachment bolt 26 will expand radially inward. By way of non-limiting example only, the annular clearance between sleeve advance section 28*b* and bolt valve bore sealing section 64*b* is at least 0.050 mm and is preferably at least 0.200 mm. As used herein, the annular clearance is defined to be the difference between the two diameters being compared, i.e. diametric clearance. Sleeve advance section 28*b* defines a first sealing ring groove 88 extending radially inward from sleeve advance section 28*b* such that first sealing ring groove 88 is annular in shape and centered about camshaft axis 16. A first sealing ring, illustrated as first O-ring 90, is located within first sealing ring groove 88 such that first O-ring 90 is compressed radially between sleeve advance section 28*b* and bolt valve bore sealing section 64*b*, thereby preventing oil from migrating from one axial side of first O-ring 90 to the other axial side of first O-ring 90. The oblique nature of the transition between bolt valve bore advance section 64*c* and bolt valve bore sealing section 64*b* allows for compression of first O-ring 90 when valve sleeve 28 is inserted into bolt valve bore 64. First O-ring 90 is resilient and compliant and may be, by way of non-limiting example only, an elastomeric or rubber-like material, for example only, Nitrile Butadiene Rubber (NBR), Viton®, or silicone. Consequently, when camshaft phaser attachment bolt 26 is tightened, the radially inward expansion of camshaft phaser attachment bolt 26 is taken up by first O-ring 90, thereby preventing valve sleeve 28 from expanding radially inward.

A sleeve retard section 28*c* is immediately adjacent to sleeve advance section 28*b* such that sleeve advance section 28*b* is located between sleeve retard section 28*c* and sleeve supply section 28*a* and such that sleeve retard section 28*c* is located partially within bolt valve bore advance section 64*c* and partially within bolt valve bore retard section 64*d*. Sleeve retard section 28*c* and bolt valve bore advance section 64*c* are sized to provide a diametric clearance therebetween which accommodates radially inward expansion of camshaft phaser attachment bolt 26 when camshaft phaser attachment bolt 26 is tightened to camshaft 14, i.e. the diametric clearance is greater than the extent to which camshaft phaser attachment bolt 26 will expand radially inward. By way of non-limiting example only, the diametric clearance between sleeve retard section 28*c* and bolt valve bore advance section 64*c* is at least 0.050 mm and is preferably at least 0.200 mm. Sleeve retard section 28*c* defines a second sealing ring groove 92 extending radially inward from sleeve retard section 28*c* such that second sealing ring groove 92 is annular in shape and centered about camshaft axis 16. A second sealing ring, illustrated as second O-ring 94, is located within second sealing ring groove 92 such that second O-ring 94 is compressed radially between sleeve retard section 28*c* and bolt valve bore advance section 64*c*, thereby preventing oil from migrating from one axial side of second O-ring 94 to the other axial side of second O-ring 94. The oblique nature of the transition between bolt valve bore retard section 64*d* and bolt valve bore advance section 64*c* allows for compression of second O-ring 94 when valve sleeve 28 is inserted into bolt valve bore 64. Second O-ring 94 is resilient and compliant and may be, by way of non-limiting example only, an elastomeric or rubber-like material, for example only, Nitrile Butadiene Rubber (NBR), Viton®, or silicone. Consequently, when camshaft phaser attachment bolt 26 is tightened, the radially inward expansion of camshaft phaser attachment bolt 26 is taken up by second O-ring 94, thereby preventing valve sleeve 28 from expanding radially inward.

A sleeve retention section 28*d* is immediately adjacent to sleeve retard section 28*c* such that sleeve retard section 28*c* is located between sleeve retention section 28*d* and sleeve advance section 28*b* and such that sleeve retention section 28*d* is located at least partially within bolt valve bore retard section 64*d*. Sleeve retention section 28*d* and bolt valve bore retard section 64*d* are sized to provide a diametric clearance therebetween which accommodates radially inward expansion of camshaft phaser attachment bolt 26 when camshaft phaser attachment bolt 26 is tightened to camshaft 14, i.e. the diametric clearance is greater than the extent to which camshaft phaser attachment bolt 26 will expand radially inward. By way of non-limiting example only, the diametric clearance between sleeve retention section 28*d* and bolt valve bore retard section 64*d* is at least 0.050 mm and is preferably at least 0.200 mm. Sleeve retention section 28*d* defines a third sealing ring groove 96 extending radially inward from sleeve retention section 28*d* such that third sealing ring groove 96 is annular in shape and centered about camshaft axis 16. A third sealing ring, illustrated as third O-ring 98, is located within third sealing ring groove 96 such that third O-ring 98 is compressed radially between sleeve retention section 28*d* and bolt valve bore retard section 64*d*, thereby preventing oil from migrating from one axial side of third O-ring 98 to the other axial side of third O-ring 98. The oblique nature of the transition between bolt valve bore retention section 64*e* and bolt valve bore retard section 64*d* allows for compression of third O-ring 98 when valve sleeve 28 is inserted into bolt valve bore 64. Third O-ring 98 is resilient and compliant and may be, by way of non-limiting example only, an elastomeric or rubber-like material, for example only, Nitrile Butadiene Rubber (NBR), Viton®, or silicone. Consequently, when camshaft phaser attachment bolt 26 is tightened, the radially inward expansion of camshaft phaser attachment bolt 26 is taken up by third O-ring 98, thereby preventing valve sleeve 28 from expanding radially inward.

For clarity, it should now be understood that sleeve retard section 28*c* is smaller in diameter than sleeve retention section 28*d*, sleeve advance section 28*b* is smaller in diameter than sleeve retard section 28*c*, and sleeve supply section 28*a* is smaller in diameter than sleeve advance section 28*b*.

As shown, valve sleeve 28 may be constructed from a single piece of material, and may be preferably made of a metallic material, for example only, steel. Alternatively, valve sleeve 28 may comprise multiple pieces that are assembled to form valve sleeve 28. For example, an inner cylinder of metal may define a portion of sleeve supply passages 102, sleeve advance passages 104, and sleeve retard and passages 106 while an outer member made of plastic material may circumferentially surround the inner cylinder and may define the remaining portions of sleeve supply passages 102, sleeve advance passages 104, sleeve retard and passages 106 and also define first sealing ring groove 88, second sealing ring groove 92, third sealing ring groove 96, sleeve annular advance groove 104*a*, and sleeve annular retard groove 106*a*. Forming valve sleeve 28 from multiple pieces may allow the more complicated geometry of valve sleeve 28 to be formed by plastic injection molding rather than more costly and complex machining operations in a metal component.

The axial position of valve sleeve 28 within bolt valve bore 64 is maintained in one axial direction by valve sleeve 28 abutting the shoulder formed by the transition between bolt valve bore sealing section 64*b* and bolt valve bore supply section 64*a* and in the other axial direction by a valve retention member 100, illustrated as a snap ring within a snap ring groove of bolt valve bore retention section 64*e*. In this way, valve sleeve 28 is prevented from moving axially within bolt valve bore 64.

Valve sleeve 28 includes passages extending radially therethrough which permit oil to enter and exit sleeve bore 60 as will now be described. Valve sleeve 28 includes sleeve supply passages 102 in sleeve supply section 28*a*. Sleeve supply passages 102 extend radially outward from sleeve bore 60 to the outer periphery of sleeve supply section 28*a*. As shown, sleeve supply passages 102 are preferably slots which each extend circumferentially to a greater extent than they extend axially. Alternatively, supply passages 102 may be a plurality of drilled holes. Sleeve supply passages 102 provide a path for oil to flow into sleeve bore 60 from annular space 86.

Valve sleeve 28 also includes sleeve advance passages 104 in sleeve advance section 28*b*. Sleeve advance passages 104 extend radially outward from sleeve bore 60 to the outer periphery of sleeve advance section 28*b* and are aligned with bolt advance passages 78 of camshaft phaser attachment bolt 26. Sleeve advance passages 104 are preferably slots which open into a sleeve annular advance groove 104*a* on the outer periphery of valve sleeve 28 to ensure that sleeve advance passages 104 are in continuous fluid communication with bolt advance passages 78 regardless of the radial orientation of valve sleeve 28 within bolt valve bore 64. Alternatively, sleeve advance passages 104 may be a plurality of drilled holes. It should be noted that sleeve advance passages 104 are located axially between first O-ring 90 and second O-ring 94.

Valve sleeve 28 also includes sleeve retard passages 106 in sleeve advance section 28*b*. Sleeve retard passages 106 extend radially outward from sleeve bore 60 to the outer periphery of sleeve retard section 28*c* and are aligned with bolt retard passages 82 of camshaft phaser attachment bolt 26. Sleeve retard passages 106 are preferably slots which open into a sleeve annular retard groove 106*a* on the outer periphery of valve sleeve 28 to ensure that sleeve retard passages 106 are in continuous fluid communication with bolt retard passages 82 regardless of the radial orientation of valve sleeve 28 within bolt valve bore 64. Alternatively, sleeve retard passages 106 may be a plurality of drilled holes. It should be noted that sleeve retard passages 106 are located axially between second O-ring 94 and third O-ring 98.

Valve spool 30 is moved axially within sleeve bore 60 of valve sleeve 28 by an actuator 105 and a valve spring 107 to achieve desired operational states of camshaft phaser 12 by opening and closing sleeve advance passages 104 and sleeve retard passages 106. Opening and closing of sleeve advance passages 104 and sleeve retard passages 106 is accomplished by aligning features of valve spool 30, which will be described in the paragraphs that follow, with sleeve advance passages 104 and sleeve retard passages 106.

Valve spool 30 includes a cylindrical outer surface which is interrupted by spool inlet slots 108, spool advance vent slots 110, spool supply slots 112, and spool retard vent slots 114 which are axially separated from each other by lands in the form of continuous annular sections of the cylindrical outer surface of valve spool 30. A spool inlet end land 116 is located at the end of valve spool 30 that is proximal to the closed end of sleeve bore 60. Spool inlet end land 116 is sized to interface with sleeve bore 60 in a close sliding fit such that spool inlet end land 116 is able to slide freely axially within sleeve bore 60 while preventing oil from passing between the interface of spool inlet end land 116 and sleeve bore 60. The diametric clearance between sleeve bore 60 and spool inlet end land 116 is no more than 0.030 mm. Valve spool 30 is retained within sleeve bore 60 by valve retention member 100. More specifically, as illustrated, valve retention member 100 that is embodied as a snap ring includes tabs that extend radially inward to prevent valve spool 30 from coming out of sleeve bore 60.

A spool inlet-advance vent land 118 is spaced axially apart from spool inlet end land 116 such that spool inlet slots 108 are terminated axially by spool inlet end land 116 and spool inlet-advance vent land 118. Spool inlet-advance vent land 118 is sized to interface with sleeve bore 60 in a close sliding fit such that spool inlet-advance vent land 118 is able to slide freely axially within sleeve bore 60 while preventing oil from passing between the interface of spool inlet-advance vent land 118 and sleeve bore 60. The diametric clearance between sleeve bore 60 and spool inlet-advance vent land 118 is no more than 0.030 mm. As shown, there are preferably two spool inlet slots 108 which are diametrically opposed to each other.

A spool supply-advance vent land 120 is spaced axially apart from spool inlet-advance vent land 118 such that spool advance vent slots 110 are terminated axially by spool inlet-advance vent land 118 and spool supply-advance vent land 120. Spool supply-advance vent land 120 is sized to interface with sleeve bore 60 in a close sliding fit such that spool supply-advance vent land 120 is able to slide freely axially within sleeve bore 60 while preventing oil from passing between the interface of spool supply-advance vent land 120 and sleeve bore 60. The diametric clearance between sleeve bore 60 and spool supply-advance vent land 120 is no more than 0.030 mm. As shown, there are preferably two spool advance vent slots 110 which are diametrically opposed to each other. Also as shown, spool advance vent slots 110 are preferably located circumferentially at a position rotated 90° relative to the circumferential location of spool inlet slots 108.

A spool supply-retard vent land 122 is spaced axially apart from spool supply-advance vent land 120 such that spool supply slots 112 are terminated axially by spool supply-advance vent land 120 and spool supply-retard vent land 122. Spool supply-retard vent land 122 is sized to interface with sleeve bore 60 in a close sliding fit such that spool supply-retard vent land 122 is able to slide freely axially within sleeve bore 60 while preventing oil from passing between the interface of spool supply-retard vent land 122 and sleeve bore 60. The diametric clearance between sleeve bore 60 and spool supply-retard vent land 122 is no more than 0.030 mm. As shown, there are preferably two spool supply slots 112 which are diametrically opposed to each other. Also as shown, spool supply slots 112 are preferably located circumferentially at a position rotated 90° relative to the circumferential location of spool advance vent slots 110 which locates spool supply slots 112 at the same circumferential location as spool inlet slots 108.

A spool retard vent-end land 124 is spaced axially apart from spool supply-retard vent land 122 such that spool retard vent slots 114 are terminated axially by spool supply-retard vent land 122 and spool retard vent-end land 124. Spool retard vent-end land 124 is sized to interface with sleeve bore 60 in a close sliding fit such that spool retard vent-end land 124 is able to slide freely axially with sleeve bore 60 while preventing oil from passing between the interface of spool retard vent-end land 124 and sleeve bore 60. The diametric clearance between sleeve bore 60 and spool retard vent-end land 124 is no more than 0.030 mm. As shown, there are preferably two spool retard vent slots 114 which are diametrically opposed to each other. Also as shown, spool retard vent slots 114 are preferably located circumferentially at a position rotated 90° relative to the circumferential location of spool inlet slots 108 which locates spool supply slots 112 at the same circumferential location as spool advance vent slots 110.

Valve spool 30 also includes spool supply passages 126 which extend axially within valve spool 30. Each spool supply passage 126 connects a respective one of spool inlet slots 108 with a respective one of spool supply slots 112. As shown, spool supply passages 126 may be formed by drilling into valve spool 30 from the axial end of valve spool 30 that defines spool retard vent-end land 124 to spool inlet slots 108, then plugging (best shown in FIGS. 3A-5B) spool supply passages 126 between spool supply slots 112 and the axial end of valve spool 30 that defines spool retard vent-end land 124. It is important to note that spool supply passages 126 do not communicate with spool advance vent slots 110 and spool retard vent slots 114. This arrangement of spool supply passages 126 is made possible by spool inlet slots 108 and spool supply slots 112 being located circumferentially at a position rotated 90° relative to the circumferential location of spool advance vent slots 110 and spool retard vent slots 114. As a result, spool supply passages 126 are each parallel to camshaft axis 16 and spool supply passages 126 are diametrically opposed to each other.

Valve spool 30 also includes spool vent passages 128 which extend axially through valve spool 30, thereby fluidly connecting opposing axial ends of valve spool 30 which define spool inlet end land 116 and spool retard vent-end land 124. Each spool vent passages 128 also fluidly connects a respective one of spool advance vent slots 110 and a respective one of spool retard vent slots 114. It is important to note that spool vent passages 128 do not communicate with spool inlet slots 108 and spool supply slots 112. This arrangement of spool vent passages 128 is made possible by spool inlet slots 108 and spool supply slots 112 being located circumferentially at a position rotated 90° relative to the circumferential location of spool advance vent slots 110 and spool retard vent slots 114. As a result, spool vent passages 128 are each parallel to camshaft axis 16 and spool supply passages 126 are diametrically opposed to each other. It is also important to note that since spool vent passages 128 connect opposing axial ends of valve spool 30, oil cannot leak into, and become trapped in the volume which contains valve spring 107.

Valve spool 30 also includes a spool actuation rod 130 which is centered about camshaft axis 16. Spool actuation rod 130 is engaged by actuator 105 to vary the position of valve spool 30 within sleeve bore 60.

Check valve 76 includes a flat disk portion 76*a* which selectively covers bolt supply passage 66. More specifically, flat disk portion 76*a* covers bolt supply passages when the oil pressure within annular space 86 exceeds the pressure of oil supplied by oil source 55. A plurality of biasing arms 76*b* extend from flat disk portion 76*a* such that biasing arms 76*b* first extend radially outward from flat disk portion 76*a*, then wrap around 180° to be axially spaced apart from, and axially aligned with, flat disk portion 76*a*. Biasing arms 76*b* are resilient and compliant such that biasing arms 76*b* engage the axial end of valve sleeve 28, thereby biasing flat disk portion 76*a* toward closing with bolt supply passage 66. However, when the pressure differential between annular space 86 and oil source 55 permits, biasing arms 76*b* are resiliently deflected to allow flat disk portion 76*a* to be separated from bolt supply passage 66. Check valve 76 may be made of spring steel which is formed by conventional metal bending and stamping techniques. While three biasing arms 76*b* have been illustrated, it should now be understood that other quantities may be provided. Furthermore, other check valve designs may be used, for example, check valves that use a spring bias ball or conical member that interface with a corresponding seat.

Actuator 105 may be a solenoid actuator that is selectively energized with an electric current of varying magnitude in order to position valve spool 30 within sleeve bore 60 at desired axial positions, thereby controlling oil flow to achieve desired operation of camshaft phaser 12.

Figure 3A:
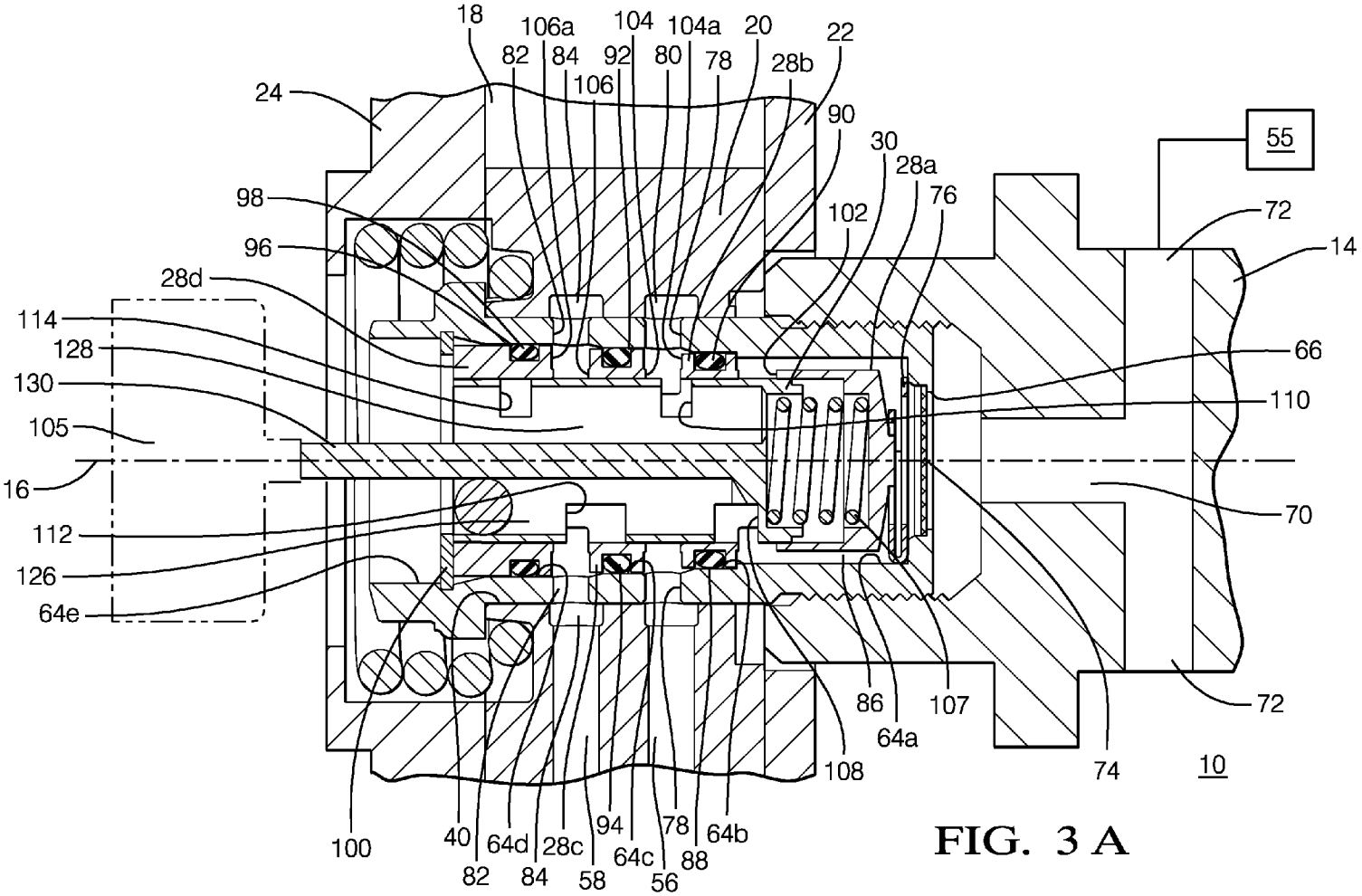
FIG. 3A. is an axial cross-sectional view of a portion of the camshaft phaser in accordance with the present invention taken through section line 3-3 in FIG. 2 and flattened out to show a valve spool of the camshaft phaser in an advance position.
Figure 3B:
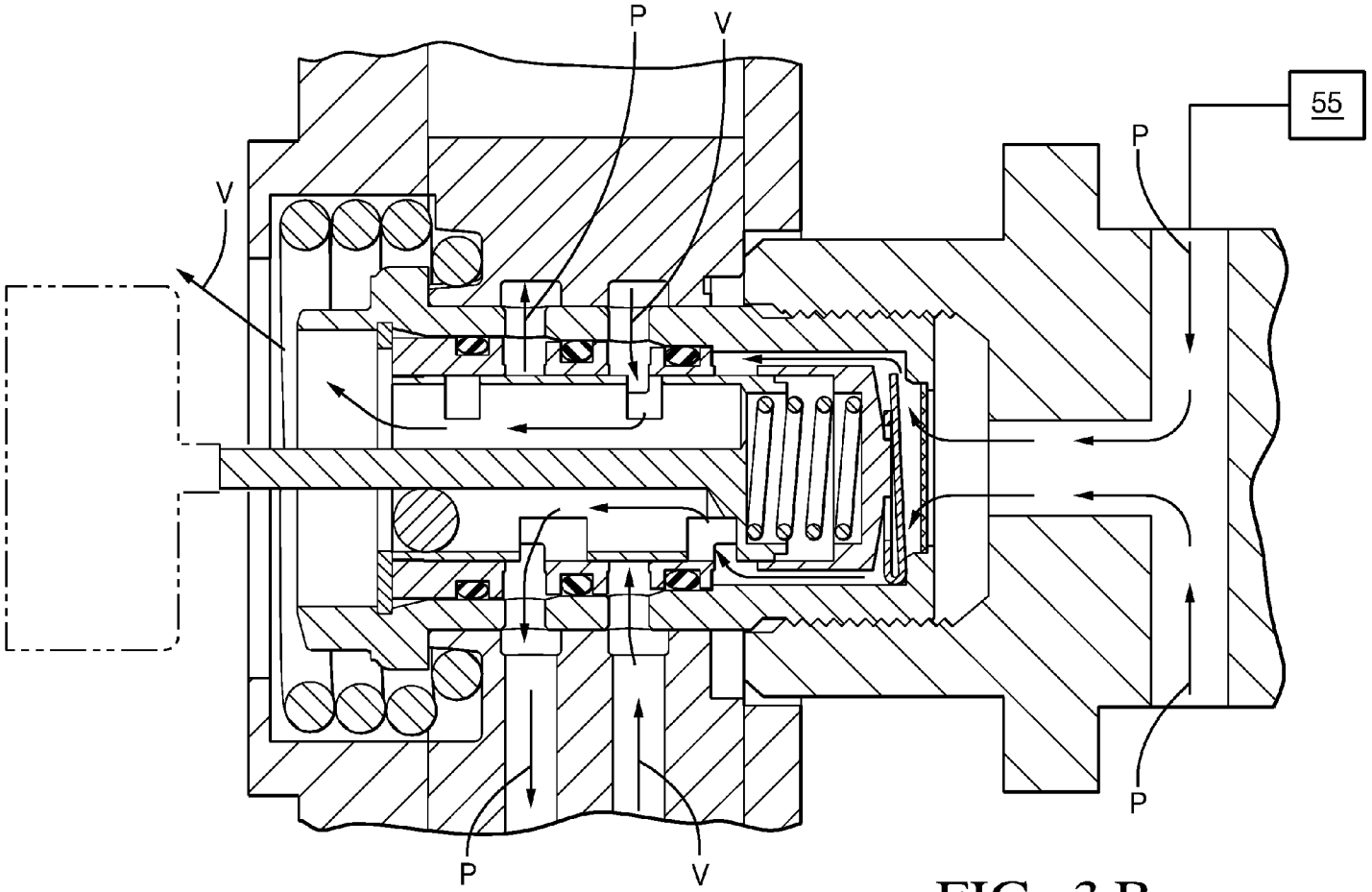
FIG. 3B is the view of FIG. 4 shown with reference numbers removed in order to clearly shown the path of travel of oil.

In an advance position, when no electric current is supplied to actuator 105 as shown in FIGS. 3A and 3B, valve spring 107 urges valve spool 30 in a direction toward actuator 105 until valve spool 30 axially abuts valve retention member 100. In the advance position, spool inlet slots 108 are positioned to be aligned with sleeve supply passages 102 of valve sleeve 28, thereby allowing pressurized oil to be supplied to spool supply passages 126 when the pressure differential is of sufficient magnitude for check valve 76 to be open. Also in the advance position, spool advance vent slots 110 are positioned to be aligned with sleeve advance passages 104 of valve sleeve 28, thereby allowing oil to be vented from advance chambers 42 via rotor advance passages 56, rotor annular advance groove 80, bolt advance passages 78, sleeve annular advance groove 104*a*, sleeve advance passages 104, spool advance vent slots 110, and spool vent passages 128. Also in the advance position, spool supply slots 112 are aligned with sleeve retard passages 106 of valve sleeve 28, thereby allowing pressurized oil to be supplied to retard chambers 44 via spool supply passages 126, spool supply slots 112, sleeve retard passages 106, sleeve annular advance groove 106*a*, bolt retard passages 82, rotor annular retard groove 84, and rotor retard passages 58. Also in the advance position, spool retard vent slots 114 are positioned to be blocked, i.e. spool retard vent slots 114 are not aligned with any of passages of valve sleeve 28. Consequently, in the advance position, pressurized oil from oil source 55 causes rotor 20 to rotate relative to stator 18 to cause an advance in timing of camshaft 14 relative to the crankshaft. In FIG. 3B, the reference numbers have been removed for clarity and arrows representing the path of travel of the oil have been included where arrows P represent pressurized oil from oil source 55 supplied to retard chambers 44 while arrows V represent vented oil from advance chambers 42. It should be noted that FIG. 5B shows check valve 76 being opened, but check valve 76 may also be closed if the pressure within annular space 86 rises above the pressure of oil source 55, for example, due to torque reversals of camshaft 14.

Figure 4A:
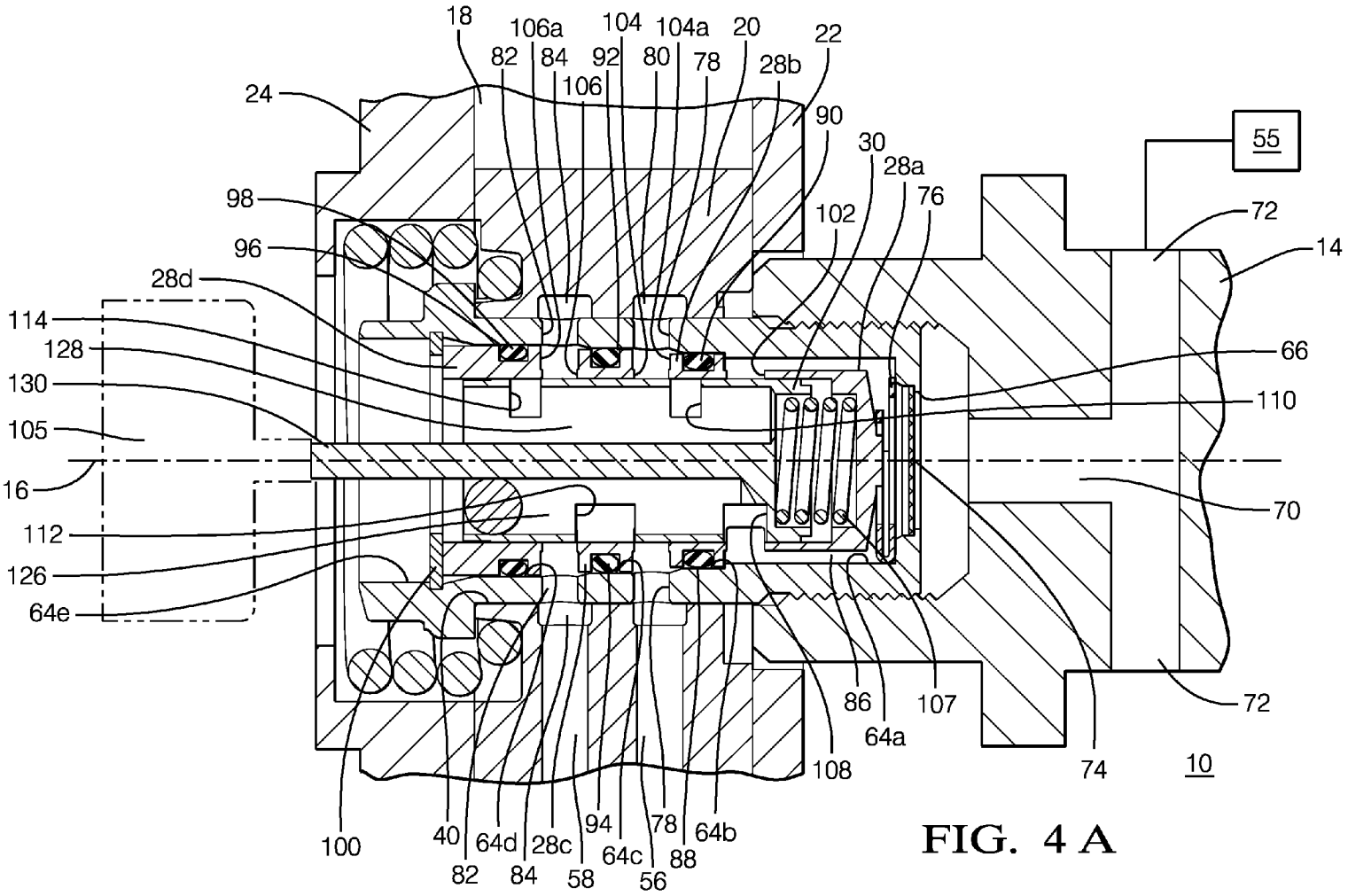
FIG. 4A is the view of FIG. 3A now shown with the valve spool in a hold position.
Figure 4B:
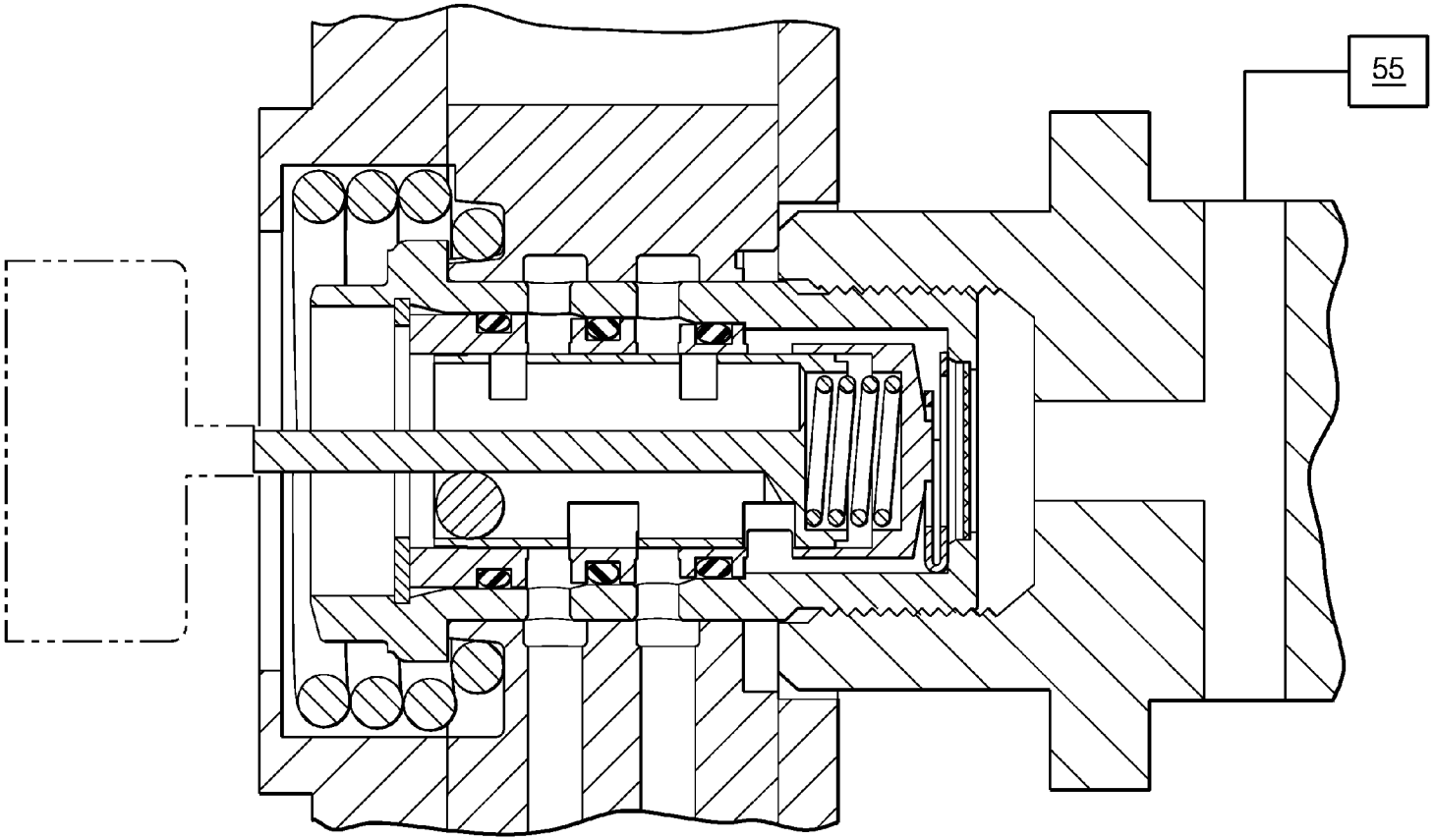
FIG. 4B is the view of FIG. 4A shown with reference numbers removed for clarity.

In a hold position, when an electric current of a first magnitude is supplied to actuator 105 as shown in FIGS. 4A and 4B, actuator 105 urges valve spool 30 in a direction toward valve spring 107 thereby causing valve spring 107 to be compressed slightly. In the hold position, spool inlet slots 108 remain positioned to be aligned with sleeve supply passages 102 of valve sleeve 28, thereby allowing pressurized oil to be supplied to spool supply passages 126 when the pressure differential is of sufficient magnitude for check valve 76 to be open. Also in the hold position, spool advance vent slots 110 are positioned to be blocked, i.e. spool advance vent slots 110 are not aligned with any of passages of valve sleeve 28. Also in the hold position, spool supply slots 112 are positioned to be in restricted fluid communication with sleeve advance passages 104 and sleeve retard passages 106 of valve sleeve 28. Also in the hold position, spool retard vent slots 114 are positioned to be blocked, i.e. spool retard vent slots 114 are not aligned with any of passages of valve sleeve 28. By providing restricted fluid communication between spool supply slots 112 and sleeve advance passages 104 and sleeve retard passages 106 of valve sleeve 28 while also blocking spool advance vent slots 110 and spool retard vent slots 114, the rotational position of rotor 20 relative to stator 18 is maintained by the hold position. Rather than providing restricted fluid communication between spool supply slots 112 and sleeve advance passages 104 and sleeve retard passages 106, sleeve advance passages 104 and sleeve retard passages 106 may alternatively be blocked in the hold position in order to maintain the rotational position of rotor 20 relative to stator 18. In FIG. 4B, the reference numbers have been removed for clarity, and since there is substantially no movement of rotor 20 relative to stator 18 and consequently substantially no flow of oil, no arrows have been provided to illustrate the lack of flow of oil.

Figure 5A:
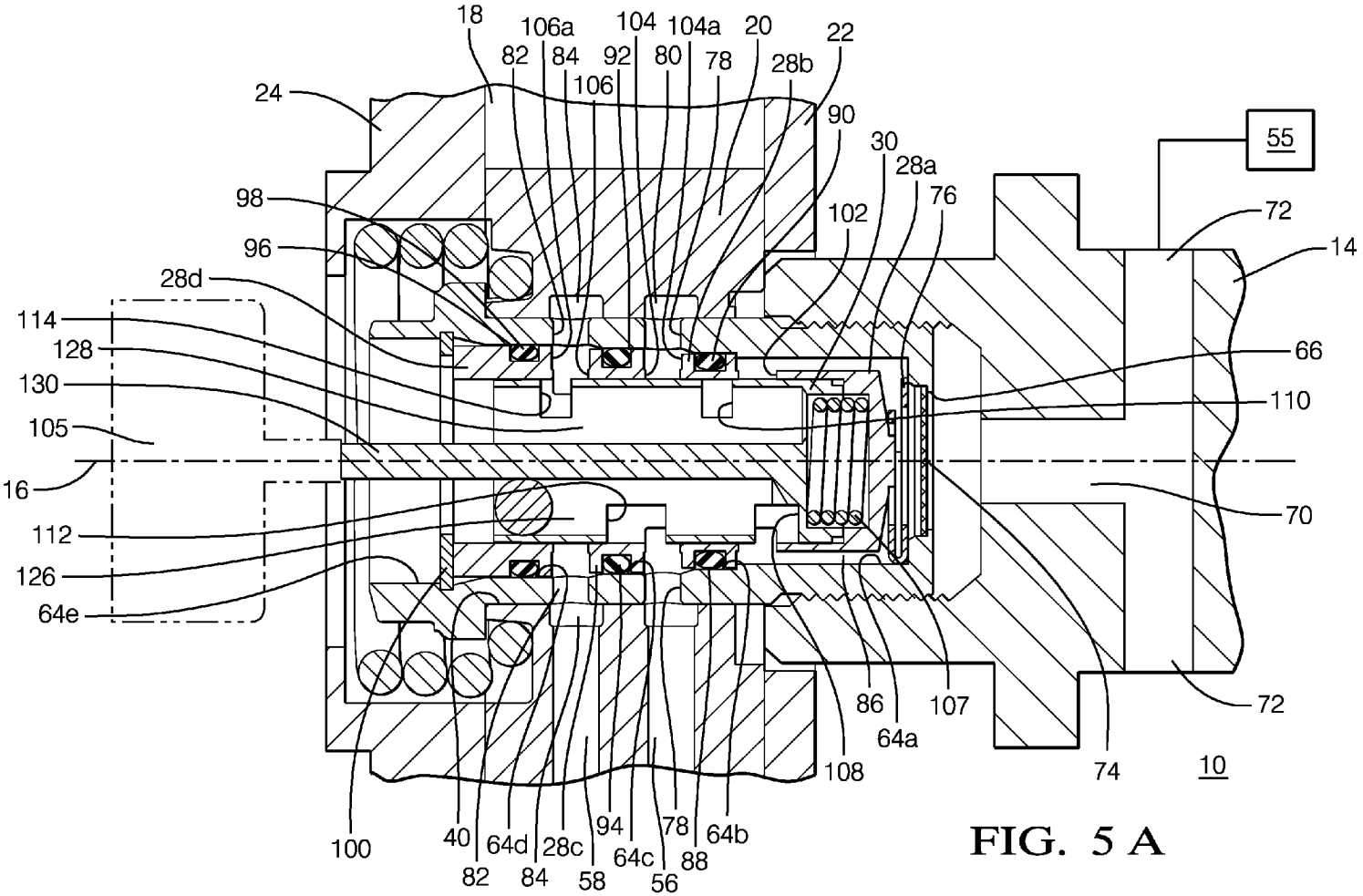
FIG. 5A is the view of FIG. 4A now shown with the valve spool in a retard position.
Figure 5B:
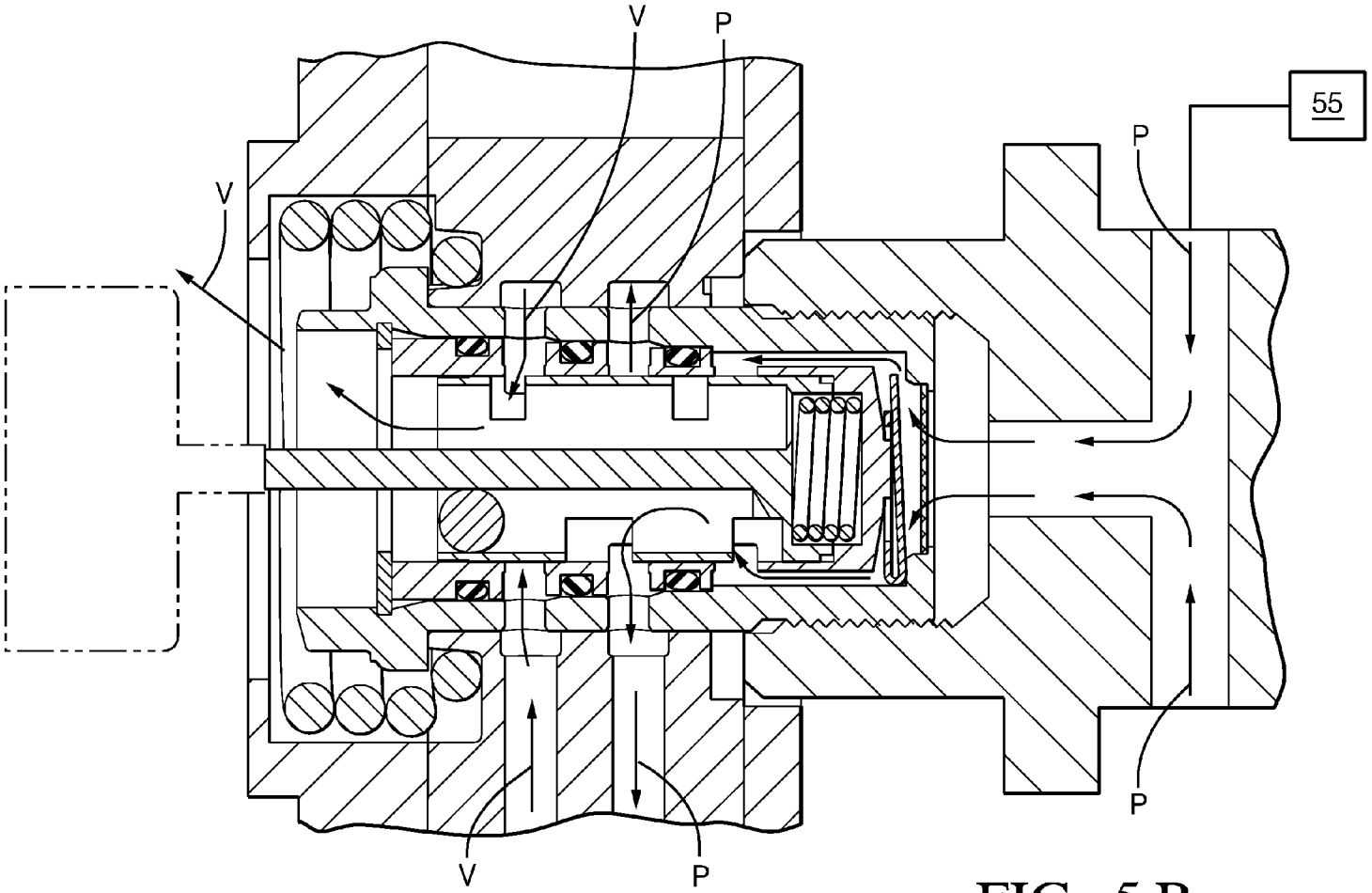
FIG. 5B is the view of FIG. 5A shown with reference numbers removed in order to clearly shown the path of travel of oil.

In a retard position, when an electric current of a second magnitude is supplied to actuator 105 as shown in FIGS. 5A and 5B, actuator 105 urges valve spool 30 in a direction toward valve spring 107 thereby causing valve spring 107 to be compressed more than in the hold position until valve spool 30 axially abuts valve sleeve 28 at the shoulder formed by the transition between bolt valve bore sealing section 64*b* and bolt valve bore supply section 64*a*. In the retard position, spool inlet slots 108 remain positioned to be aligned with sleeve supply passages 102 of valve sleeve 28, thereby allowing pressurized oil to be supplied to spool supply passages 126 when the pressure differential is of sufficient magnitude for check valve 76 to be open. Also in the retard position, spool retard vent slots 114 are positioned to be blocked, i.e. spool retard vent slots 114 are not aligned with any of passages of valve sleeve 28. Also in the retard position, spool supply slots 112 are positioned to be aligned with sleeve advance passages 104 of valve sleeve 28, thereby allowing pressurized oil to be supplied to advance chambers 42 via spool supply slots 112, spool advance vent slots 110, sleeve advance passages 104, sleeve annular advance groove 104*a*, bolt advance passages 78, rotor annular advance groove 80, and rotor advance passages 56. Also in the retard position, spool retard vent slots 114 are positioned to be aligned with sleeve retard passages 106 of valve sleeve 28, thereby allowing oil to be vented from retard chambers 44 via rotor retard passages 58, rotor annular retard groove 84, bolt retard passages 82, sleeve annular retard groove 106*a*, sleeve retard passages 106, spool retard vent slots 114, and spool vent passages 128. Consequently, in the retard position, pressurized oil from oil source 55 causes rotor 20 to rotate relative to stator 18 to cause a retard in timing of camshaft 14 relative to the crankshaft. In FIG. 7B, the reference numbers have been removed for clarity and arrows representing the path of travel of the oil have been included where arrows P represent pressurized oil from oil source 55 supplied to advance chambers 42 while arrows V represent vented oil from retard chambers 44. It should be noted that FIG. 7B shows check valve 76 being opened, but check valve 76 may also be closed if the pressure within annular space 86 rises above the pressure of oil source 55, for example, due to torque reversals of camshaft 14.

Figure 2:
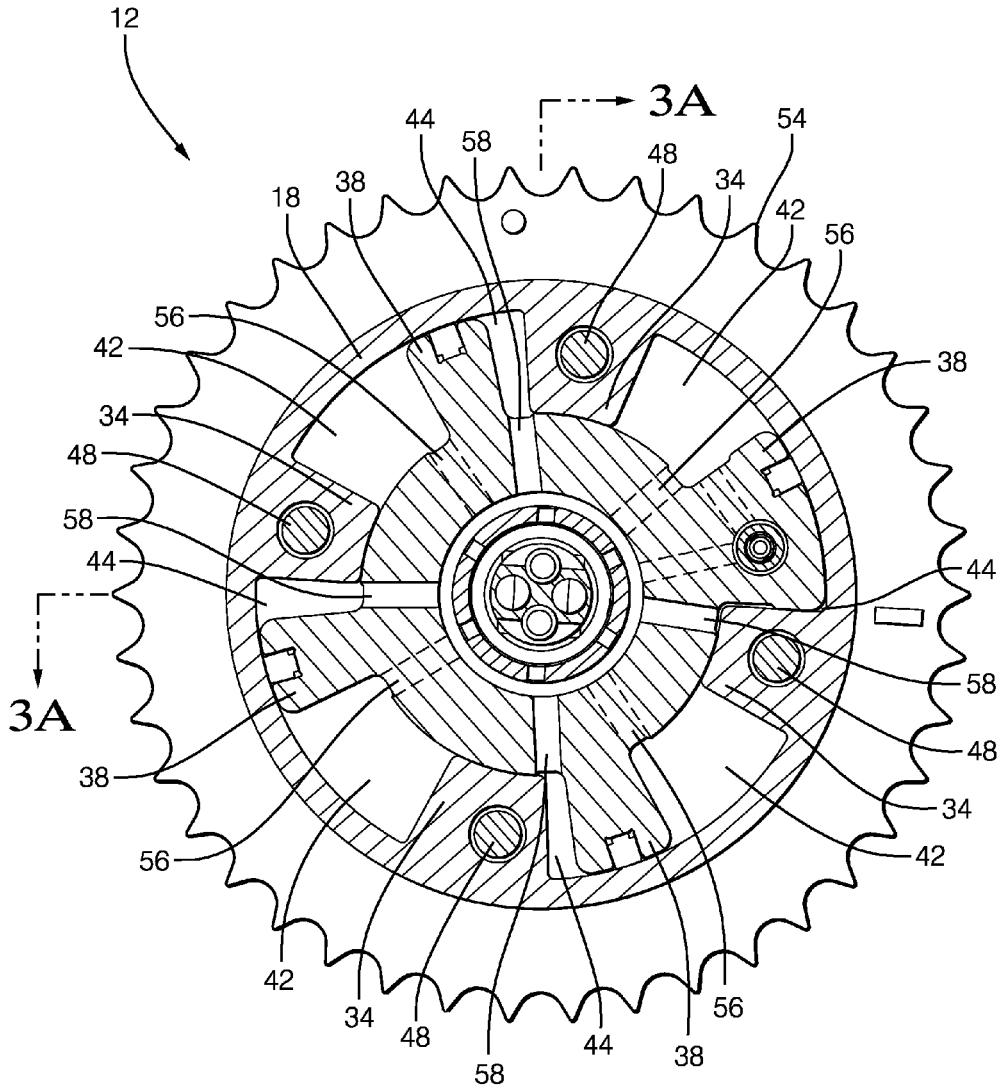
FIG. 2 is a radial cross-sectional view of the camshaft phaser in accordance with the present invention.

While camshaft phaser 12 has been described as defaulting to full advance, it should now be understood that camshaft phaser 12 may alternatively default to full retard by simply rearranging oil passages. Similarly, while full advance has been described as full counterclockwise rotation of rotor 20 within stator 18 as shown in FIG. 2, it should also now be understood that full advance may alternatively be full clockwise rotation of rotor 20 within stator 18 depending on whether camshaft phaser 12 is mounted to the front of internal combustion engine 10 (shown in the figures) or to the rear of internal combustion engine 10. As such, bolt valve bore advance section 64*c* and bolt valve bore retard section 64*d* may be generically referred to as bolt valve bore first phasing section 64*c* and bolt valve bore second phasing section 64*d* respectively. Similarly, sleeve advance section 28*b* and sleeve retard section 28*c* may be generically be referred to as sleeve first phasing section 28*b* and sleeve second phasing section 28*c* respectively.

Valve sleeve 28 as described herein allows valve spool 30 to be isolated from radially inward expansion of camshaft phaser attachment bolt 26 when camshaft phaser attachment bolt 26 is tightened to camshaft 14. More specifically, the clearance between valve sleeve 28 and bolt valve bore 64 is sufficiently large to accommodate the radially inward expansion of camshaft phaser attachment bolt 26. Furthermore, the clearance between valve sleeve 28 and bolt valve bore 64 is not relied upon to prevent oil leakage therebetween. Instead, first O-ring 90, second O-ring 94, and third O-ring 98 are used seal between valve sleeve 28 and bolt valve bore 64, thereby ensuring an oil-tight interface. First O-ring 90, second O-ring 94, and third O-ring 98 are each compliant in order to take up the radially inward expansion of camshaft phaser attachment bolt 26 without resulting in radially inward expansion of valve sleeve 28. In this way, the clearance between valve spool 30 and sleeve bore 60 can be minimized to prevent oil leakage at the interface of valve spool 30 and sleeve bore 60 since valve sleeve 28 will not incur radially inward expansion due to camshaft phaser attachment bolt 26 expanding radially inward.

While camshaft phaser 12 has been embodied herein as being actuated by pressurized oil from oil source 55, it should now be understood that camshaft phaser 12 could alternatively be modified to be actuated by using torque reversals of camshaft 14 which alternatingly pressurize oil in advance chambers 42 and retard chambers 44. As in known to those of ordinary skill in the art of camshaft phasers, torque reversals of camshaft 14 can be used to rotate rotor 20 within stator 18 in a controlled manner by inclusion of one or more check valves.

While this invention has been described in terms of preferred embodiments thereof, it is not intended to be so limited, but rather only to the extent set forth in the claims that follow.

I claim:

1. A camshaft phaser for use with an internal combustion engine for controllably varying the phase relationship between a crankshaft and a camshaft in said internal combustion engine, said camshaft phaser comprising:

an input member connectable to said crankshaft of said internal combustion engine to provide a fixed ratio of rotation between said input member and said crankshaft;

an output member connectable to said camshaft of said internal combustion engine and defining an advance chamber and a retard chamber with said input member;

a camshaft phaser attachment bolt which clamps said camshaft phaser to said camshaft, said camshaft phaser attachment bolt having a bolt valve bore extending along an axis, a bolt advance passage providing fluid communication between said advance chamber and said bolt valve bore, and a bolt retard passage providing fluid communication between said retard chamber and said bolt valve bore;

a valve sleeve coaxially within said bolt valve bore such that an annular clearance is defined radially between said valve sleeve and said bolt valve bore, said valve sleeve having a sleeve bore, a sleeve advance passage proving fluid communication between said bolt advance passage and said sleeve bore, and a sleeve retard passage providing fluid communication between said bolt retard passage and said sleeve bore;

a valve spool within said sleeve bore, said valve spool being displaced axially within said sleeve bore between 1) an advance position which directs oil into said retard chamber and vents oil from said advance chamber, thereby causing said output member to rotate relative to said input member in an advance direction and 2) a retard position which directs oil into said advance chamber and vents oil from said retard chamber, thereby causing said output member to rotate relative to said input member in a retard direction; and a compliant sealing ring radially between said bolt valve bore and said valve sleeve which engages said bolt valve bore and said valve sleeve, said sealing ring preventing fluid communication through said annular clearance axially between opposing axial sides of said sealing ring and said sealing ring also accommodating radially inward expansion of said camshaft phaser attachment bolt within said annular clearance such that said sealing ring isolates said valve sleeve from radial expansion of said camshaft phaser attachment bolt.

2. A camshaft phaser as in claim 1 wherein said sealing ring prevents fluid communication between said bolt advance passage and said bolt retard passage through said annular clearance.

3. A camshaft phaser as in claim 1 wherein said annular clearance is at least 0.050 mm.

4. A camshaft phaser as in claim 3 wherein said annular clearance is at least 0.200 mm.

5. A camshaft phaser as in claim 3 wherein a diametric clearance between said valve spool and said sleeve bore is no more than 0.030 mm.

6. A camshaft phaser as in claim 1 wherein said bolt valve bore defines:

a bolt valve bore supply section having a first bolt diameter such that pressurized oil is received within said bolt valve bore at said bolt valve bore supply section;

a bolt valve bore sealing section having a second bolt diameter which is larger than said first bolt diameter;

a bolt valve bore first phasing section having a third bolt diameter which is larger than said second bolt diameter, said bolt valve bore sealing section being axially between said bolt valve bore first phasing section and said bolt valve bore supply section; and a bolt valve bore second phasing section having a fourth bolt diameter which is larger than said third bolt diameter, said bolt valve bore first phasing section being axially between said bolt valve bore second phasing section and said bolt valve bore sealing section;

wherein said sealing ring is a first sealing ring, said first sealing ring being within said bolt valve bore sealing section and preventing fluid communication through said annular clearance between said bolt valve bore supply section and said bolt valve bore first phasing section; and wherein a compliant second sealing ring located radially between said bolt valve bore and said valve sleeve within said bolt valve bore first phasing section engages said bolt valve bore and said valve sleeve, said second sealing ring preventing fluid communication through said annular clearance between said bolt valve bore first phasing section and said bolt valve bore second phasing section and said second sealing ring also accommodating radially inward expansion of said camshaft phaser attachment bolt within said annular clearance such that said second sealing ring isolates said valve sleeve from radial expansion of said camshaft phaser attachment bolt.

7. A camshaft phaser as in claim 6 wherein a compliant third sealing ring located radially between said bolt valve bore and said valve sleeve within said bolt valve bore second phasing section engages said bolt valve bore and said valve sleeve, said third sealing ring preventing fluid communication through said annular clearance between said bolt valve bore second phasing section and an open end of said bolt valve bore and said third sealing ring also accommodating radially inward expansion of said camshaft phaser attachment bolt within said annular clearance such that said third sealing ring isolates said valve sleeve from radial expansion of said camshaft phaser attachment bolt.

8. A camshaft phaser as in claim 6 wherein said valve sleeve defines:

a sleeve supply section having a first sleeve diameter, said sleeve supply section being located within said bolt valve bore supply section;

a sleeve first phasing section having a second sleeve diameter which is larger than said first sleeve diameter, said sleeve first phasing section being located within said bolt valve bore sealing section and within said bolt valve bore first phasing section; and a sleeve second phasing section having a third sleeve diameter which is larger than said second sleeve diameter such that said sleeve first phasing section is axially between said sleeve second phasing section and said sleeve supply section, said sleeve second phasing section being located within said bolt valve bore second phasing section and said bolt valve bore first phasing section.

9. A camshaft phaser as in claim 8 wherein said sleeve supply section includes a sleeve supply passage extending radially therethrough which provides fluid communication between said bolt valve bore supply section and said sleeve bore.

10. A camshaft phaser as in claim 8 wherein:

said sleeve first phasing section defines a first sealing ring groove extending radially inward therefrom within which said first sealing ring is located; and said sleeve second phasing section defines a second sealing ring groove extending radially inward therefrom within which said second sealing ring is located.

11. A camshaft phaser as in claim 10 wherein said valve sleeve further defines a sleeve retention section having a fourth sleeve diameter which is larger than said third sleeve diameter such that said sleeve second phasing section is axially between said sleeve retention section and said sleeve first phasing section, said sleeve retention section being located within said bolt valve bore second phasing section.

12. A camshaft phaser as in claim 11 wherein said sleeve retention section defines a third sealing ring groove extending radially inward therefrom within which said third sealing ring is located.

13. A camshaft phaser as in claim 1 wherein said valve sleeve includes a sleeve supply passage which communicates oil radially into said sleeve bore from said bolt valve bore.

14. A camshaft phaser as in claim 13 wherein said valve spool comprises:

a spool inlet slot which receives pressurized oil from said sleeve supply passage; and a spool supply slot axially spaced from said spool inlet slot, such that said spool inlet slot is in fluid communication with said spool supply slot through a spool supply passage which extends axially within said valve spool;

wherein said spool supply passage is in fluid communication with said sleeve advance passage when said valve spool is in said retard position and fluid communication between said spool supply passage and said sleeve advance passage is prevented when said valve spool is in said advance position; and wherein said spool supply passage is in fluid communication with said sleeve retard passage when said valve spool is in said advance position and fluid communication between said spool supply passage and said sleeve retard passage is prevented when said valve spool is in said retard position.

15. A camshaft phaser as in claim 14 wherein said valve spool further comprises:

a spool advance vent slot located at an axial position on said valve spool that is between said spool inlet slot and said spool supply slot; and a spool retard vent slot located at an axial position on said valve spool such that said spool supply slot is between said spool advance vent slot and said spool retard vent slot;

wherein said spool advance vent slot is in fluid communication with said sleeve advance passage when said valve spool is in said advance position and fluid communication between said spool advance vent slot and said sleeve advance passage is prevented when said valve spool is in said retard position; and wherein said spool retard vent slot is in fluid communication with said sleeve retard passage when said valve spool is in said retard position and fluid communication between said spool retard vent slot and said sleeve retard passage is prevented when said valve spool is in said advance position.

16. A camshaft phaser as in claim 15 wherein said spool advance vent slot is in fluid communication with said spool retard vent slot through a spool vent passage which extends axially within said valve spool.

17. A camshaft phaser as in claim 16 wherein said spool vent passage extends through said valve spool and fluidly connects opposing axial ends of said valve spool.

* * * * *